US007678943B2

(12) United States Patent
Gosling et al.

(10) Patent No.: US 7,678,943 B2
(45) Date of Patent: Mar. 16, 2010

(54) PROCESS FOR PRODUCING HYDROPEROXIDES

(75) Inventors: Christopher D. Gosling, Roselle, IL (US); Ronald M. Gatan, Chicago, IL (US); Paul T. Barger, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 11/874,433

(22) Filed: Oct. 18, 2007

(65) Prior Publication Data

US 2008/0039664 A1 Feb. 14, 2008

Related U.S. Application Data

(62) Division of application No. 11/184,591, filed on Jul. 19, 2005, now Pat. No. 7,297,253.

(51) Int. Cl.
*C07C 409/00* (2006.01)

(52) U.S. Cl. ..... 568/576

(58) Field of Classification Search ..... 568/576
See application file for complete search history.

(56) References Cited

U.S. PATENT DOCUMENTS

| | | | | |
|---|---|---|---|---|
| 5,436,375 | A * | 7/1995 | Thomas et al. | 568/571 |
| 6,277,271 | B1 * | 8/2001 | Kocal | 208/212 |
| 7,038,090 | B1 * | 5/2006 | Brandvold et al. | 568/575 |

FOREIGN PATENT DOCUMENTS

| | | | |
|---|---|---|---|
| JP | 2001011045 | * | 1/2001 |
| JP | 2003231674 | * | 8/2003 |

OTHER PUBLICATIONS

Levenspiel, O.; Chapter 6: Design for Single Reactions; Chemical Reaction Engineering; 1962, 1972; pp. 124-162; 2nd Ed.; John Wiley & Sons, Inc.; USA.

* cited by examiner

*Primary Examiner*—Jafar Parsa
*Assistant Examiner*—Chukwuma O Nwaonicha
(74) *Attorney, Agent, or Firm*—James C Paschall; Kurt D Van Tassel

(57) ABSTRACT

A process for the autocatalytic production of organic hydroperoxides and ultra low sulfur diesel boiling range hydrocarbons is disclosed. The organic hydroperoxides react with sulfur compounds to produce sulfones, and the sulfones can be removed from the diesel boiling range hydrocarbons to provide ultra low sulfur diesel.

12 Claims, 1 Drawing Sheet

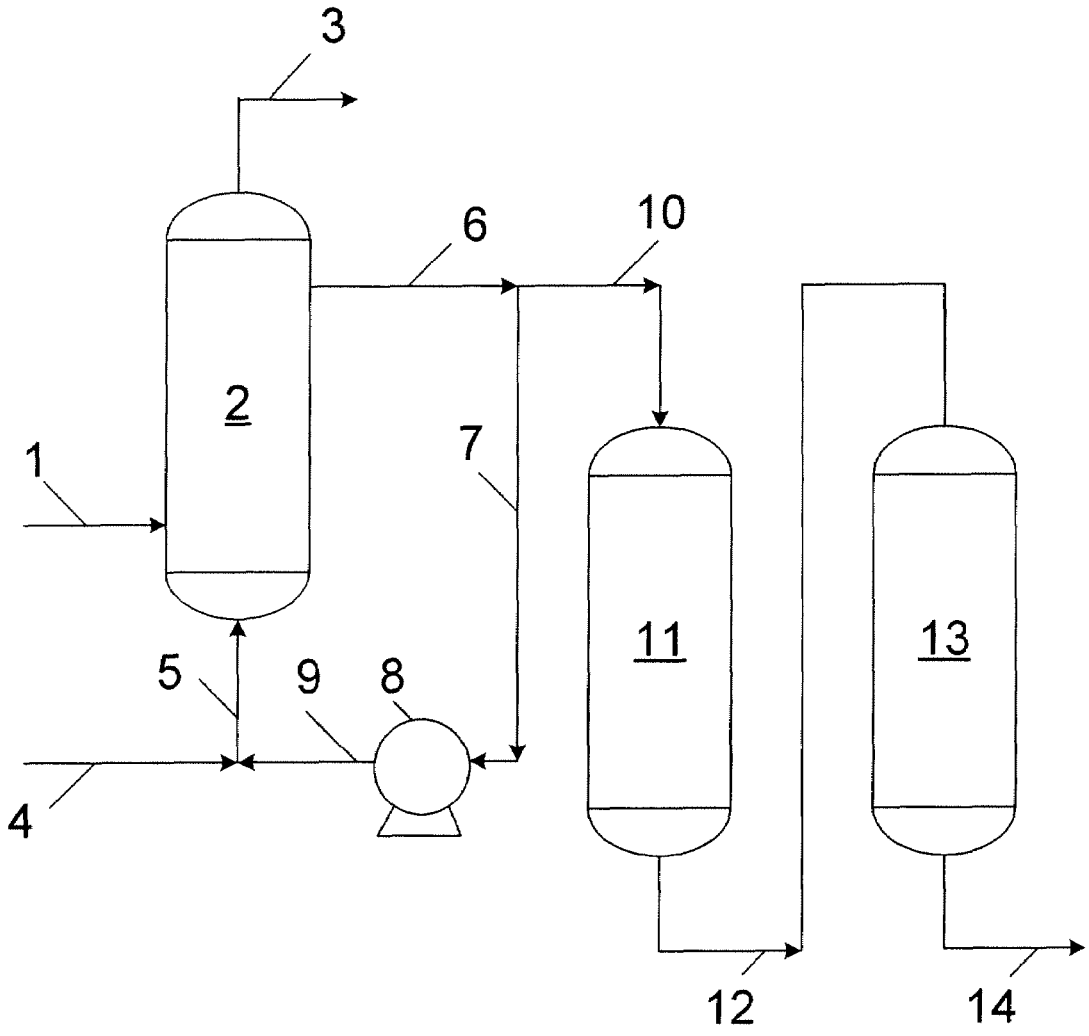
3
6
10
2
7
1
11
13
5
9
8
4
12
14

PROCESS FOR PRODUCING HYDROPEROXIDES

CROSS-REFERENCE TO RELATED APPLICATION

This application is a Division of copending application Ser. No. 11/184,591 filed Jul. 19, 2005, the contents of which are hereby incorporated by reference in its entirety.

FIELD OF THE INVENTION

The present invention relates to a process for the autocatalytic preparation of organic hydroperoxides by oxidizing hydrocarbon compounds in the presence of an oxygen containing gas. Preferred hydrocarbon feedstocks include diesel boiling range hydrocarbons.

BACKGROUND OF THE INVENTION

It is known that compounds possessing a carbon-hydrogen bond can be oxidized with molecular oxygen to products containing a hydroperoxide group where the original carbon-hydrogen bond was located. The resulting hydroperoxide is useful in the conversion of sulfur containing hydrocarbons to sulfur oxidized compounds which may then be more easily removed from a hydrocarbon stream containing sulfur compounds. Depending upon the particular starting compound, hydroperoxides can be produced with rather high selectivity under suitable oxidation conditions. At the same time, it is recognized that in order to achieve a reasonable degree of selectivity to the desired hydroperoxide, relatively mild conditions need to be utilized because under more severe conditions oxidation of the starting compound can proceed in a non-selective manner and can oxidize the starting compound to such products as carbon dioxide and water under extreme conditions. Under the relatively mild conditions needed for the selective oxidation of the starting compounds to hydroperoxides, a penalty is then exacted from the process in terms of the relatively slow reaction rate for the oxidation reaction. Hence, it is desirable to provide a relatively selective oxidation reaction for the production of hydroperoxides while at the same time attaining a faster rate of oxidation under the relatively mild conditions utilized. Until the present time, organic hydroperoxides have been produced in the presence of a catalyst. In accordance with the present invention, organic hydroperoxides may be successfully produced at reasonable rates without a catalyst.

INFORMATION DISCLOSURE

U.S. Pat. No. 5,504,256 (Bond et al.) discloses a method for preparing hydroperoxides by oxidizing aryl alkyl hydrocarbons having a benzylic hydrogen with an oxygen containing gas using as a catalyst an oxo (hydroxo) bridged tetranuclear metal complex having a mixed metal core, one metal of the core being a divalent metal selected from Zn, Cu, Fe, Co, Ni, Mn or mixtures thereof and another metal being a trivalent metal selected from In, Fe, Mn, Ga and Al.

U.S. Pat. No. 4,201,875 (Wu et al.) discloses the preparation of organic hydroperoxides by reacting an organic compound with oxygen in the presence of a catalyst comprising metallic silver supported upon an inorganic support selected from the oxides and carbonates of metals of Groups IIA, IIB, IIIB and IVB.

SUMMARY OF THE INVENTION

In one embodiment, the present invention provides a process for autocatalytically preparing organic hydroperoxides. Hydroperoxides are produced by autocatalytically reacting an organic compound with oxygen and a recycle stream containing trace quantities of hydroperoxides. The present invention is applicable to the oxidation of an organic compound containing at least one carbon-hydrogen bond capable of being oxidized to a hydroperoxide-carbon bond. A preferred hydrocarbon feedstock contains diesel boiling range hydrocarbons. It has been found that hydroperoxides may be made without a solid catalyst. As defined herein, the term "autocatalytic" means an oxidation reaction performed without a catalyst.

In another embodiment, a stream containing diesel boiling range hydrocarbons and organic peroxides is reacted in the presence of an organic sulfur oxidation catalyst to produce a stream containing diesel boiling range hydrocarbons and sulfone compounds. In yet another embodiment, the stream containing diesel boiling range hydrocarbons and sulfones is separated to produce a stream containing diesel boiling range hydrocarbons having a reduced concentration of sulfur and a stream containing sulfones.

Other embodiments of the present invention encompass further details such as feedstocks and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not to be a limitation thereof.

DETAILED DESCRIPTION OF THE INVENTION

In accordance with the present invention, hydroperoxides are produced by reacting a diesel boiling range feedstock preferably containing sulfur compounds, oxygen and a recycle stream comprising diesel boiling range hydrocarbons and trace quantities of organic hydroperoxide. The production of hydroperoxides is performed without the use of a solid catalyst.

Any suitable diesel boiling range hydrocarbon feedstock may be used in the present invention. A preferred hydrocarbon feedstock contains heterocyclic compounds containing sulfur and boils in the range from about 140° C. (284° F.) to about 380° C. (716° F.). The sulfur level in the hydrocarbon feedstock preferably is in an amount from about 1 wppm to about 1000 wppm.

The oxygen reactant may be from any suitable source including a pure oxygen stream or an oxygen containing gas stream such as air, for example. Air is a preferred source for the oxygen because of its ready availability. A preferred weight ratio of oxygen to fresh hydrocarbon feed is in the range from about 0.001:1 to about 0.01:1.

The trace quantities of organic hydroperoxide which are recycled with diesel boiling range hydrocarbons are preferably generated in-situ during the start-up of the process. An induction period may be required during the initial preparation of the organic hydroperoxide in order to achieve the desired concentration of the organic hydroperoxide in the reactor and the recycle stream. In this regard, induction periods may also be essentially eliminated by the addition of a small amount of a hydroperoxide other than the hydroperoxide product expected. In this context, the added hydroperoxide is called an initiator. Hydroperoxides that may be suitable initiators are those which decompose under the reaction conditions quickly enough to reduce the induction period. Examples of suitable initiators include cumene hydroperoxide and cyclohexybenzene hydroperoxide. Generally, hydroperoxide initiators are effective in amounts in the range from about 0.2 to about 1.5 wt-% of the fresh feedstock. Not wishing to be bound by any theory, the autocatalytic production of hydroperoxides is believed to be started or initiated in the presence of organic compounds and oxygen by the disassociation of oxygen to produce free radicals which then proceed to react with the organic compounds to produce sulfones. No solid catalyst is therefore used in the production of organic hydroperoxides.

The organic oxidation reaction in accordance with the present invention can be carried out in any batch or continuous reactor that is capable of withstanding the pressures and oxidizing conditions which are present. In a preferred embodiment, the production of organic hydroperoxide is performed in a circulating recycle system as shown in the Figure to closely simulate a backmixed reactor. The process of the present invention may also be performed in a packed plug flow reactor with a hydrocarbon recycle stream containing organic hydroperoxides. The reactor may also include internal heat exchange capabilities. The process may also utilize a traditional backmixed stirred tank reactor. The oxygen may be introduced into the reactor with the hydrocarbon feedstock or may directly be introduced with a sparger. The reaction vessel and any associated piping may be lined with materials such as glass or ceramic or constructed of materials such as stainless steel, Monel, titanium or the like. The oxidation reaction is preferably conducted at conditions include a temperature from about 110° C. (230° F.) to about 170° C. (338° F.), a pressure from about 100 kPa (0 psig) to about 1824 kPa (250 psig) and a weight ratio of recycle to fresh feed in the range from about 0.1:1 to about 4:1. The recycle stream preferably comprises trace quantities of organic hydroperoxide. By trace quantities, it is meant that the recycle stream preferably comprises organic hydroperoxides in an amount from about 50 to about 5000 wppm as oxygen.

It has been discovered that when a diesel boiling range hydrocarbon containing sulfur compounds is oxidized in the presence of oxygen and a recycle stream comprising diesel boiling range hydrocarbons and trace quantities of organic hydroperoxide to produce organic hydroperoxides, at least a portion of the sulfur compounds are found to be converted to sulfones. In order to convert essentially all of the sulfur compounds to sulfones, the effluent stream from the hydroperoxide production reaction zone is reacted in an organic sulfur oxidation zone containing an organic sulfur oxidation catalyst. The effluent stream from hydroperoxide production reaction zone contains diesel boiling range hydrocarbons containing sulfur, organic hydroperoxides and sulfones. During the reaction in the organic sulfur oxidation reaction zone, the effluent from the hydroperoxide reaction zone is reacted with an organic sulfur oxidation catalyst to produce sulfones from hydrocarbons containing sulfur. Any suitable catalyst which is capable of reacting sulfur compounds and hydroperoxide to produce sulfones may be utilized. A preferred suitable catalyst may be selected from the group consisting of a molybdenum compound, such as $MoO_3$, $MgMoO_4$ supported on an inorganic oxide support such as alumina, silica, MgO, $ZrO_2$ and ZnO. Preferred operating conditions in the organic sulfur oxidation zone include a pressure from about 100 kPa (0 psig) to about 3550 kPa (500 psig) and a temperature from about 49° C. (120° F.) to about 180° C. (356° F.). The high conversion of sulfur compounds to sulfones is highly desirable and the residual sulfur concentration in an organic sulfur oxidation zone effluent is preferably less than 50 wppm and more preferably less than 10 wppm.

In order to produce a diesel boiling range hydrocarbon stream having a low concentration of total sulfur, the sulfones are preferably, in one embodiment of the present invention, removed from the organic sulfur oxidation zone effluent. The removal and segregation of the sulfones is preferably conducted by contacting the diesel boiling range hydrocarbon stream containing sulfones with an adsorbent which selectively adsorbs sulfones. Spent adsorbent containing sulfones is then preferably regenerated by desorption of the sulfones and the regenerated adsorbent is subsequently returned to service. Any suitable adsorbent which selectively adsorbs sulfones may be utilized in the process of the present invention. Preferred adsorbents include silica gel, zeolites and alumina. Preferred operating conditions in an adsorption zone include a pressure from about 100 kPa (14.7 psig) to about 3550 kPa (500 psig) and a temperature from about 40° C. (104° F.) to about 200° C. (392° F.). Regeneration of spent adsorbent containing sulfones is preferably conducted by contacting the spent adsorbent with a suitable desorbent including pentane, hexane, benzene, toluene, xylene and admixtures thereof, for example. Once the sulfone is removed from the spent adsorbent, the regenerated adsorbent containing a reduced level of sulfone may be reused to adsorb additional sulfone. The flow of streams may be up flow or down flow through vessels. Flow directions shown in the drawing are preferred embodiments of the invention.

DETAILED DESCRIPTION OF THE DRAWING

A diesel boiling range hydrocarbon feedstock containing sulfur compounds is introduced into the process via line 4 and is admixed with a circulating recycle stream provided by line 9 containing diesel boiling range hydrocarbons and trace quantities of organic hydroperoxide. The resulting admixture is carried via line 5 and introduced into reaction zone 2. An oxygen containing gaseous stream is introduced via line 1 into reaction zone 2 containing no solid catalyst. A vent gas stream containing unreacted gas such as oxygen and nitrogen, for example, is removed from reaction zone 2 via line 3 and recovered. A stream containing diesel boiling range hydrocarbons having an increased concentration of organic hydroperoxides is removed from reaction zone 2 via line 6 and a portion thereof is transported and circulated via line 7 and introduced into pump 8. A resulting pressurized stream is removed from pump 8, carried via line 9 and admixed with the diesel boiling range hydrocarbon feedstock as hereinabove described. Another portion of the effluent stream from reaction zone 2, which is initially carried via line 6, is transported via line 10 and introduced into organic sulfur oxidation zone 11 containing an organic sulfur oxidation catalyst. A resulting stream containing diesel boiling range hydrocarbons and sulfones is removed from organic sulfur oxidation zone 11 via line 12 and introduced into sulfone adsorption zone 13 containing an adsorbent. A resulting stream having a reduced concentration of sulfones is removed from sulfone adsorption zone 13 via line 14 and recovered.

Example

A diesel boiling range hydrocarbon fresh feed having the characteristics presented in the following table was introduced into a circulating reaction loop maintained at a pressure of about 7.0 MPa (1000 psig) and a temperature of about 130° C. (266° F.). The elevated pressure was used to ensure the complete solubility of oxygen in the liquid hydrocarbon phase to prevent the formation of any explosive mixture during the testing for the example. Air was added to provide a weight ratio of oxygen to fresh feed of about 0.015. After about 350 hours elapsed time, the oxidized hydrocarbon product contained about 2000 wppm oxygen as peroxide and about 130 wppm total organic sulfur of which about 46 wppm organic sulfur was converted to sulfones and about 84 wppm organic sulfur remained unconverted. No catalyst was used in the circulating reaction loop to produce hydroperoxides.

Organic sulfur and organic hydroperoxide in a portion of the effluent oxidized hydrocarbon product from the circulation reaction loop was reacted in an organic sulfur oxidation zone in the presence of a catalyst containing $MgMoO_4$ supported on alpha alumina to produce a product stream containing about 8 wppm unoxidized sulfur and about 122 wppm oxidized sulfur as sulfone. The organic sulfur oxidation zone was operated at a temperature of about 110° C. and a pressure of about 1824 kPa (250 psig).

A portion of the product stream containing about 8 wppm unoxidized sulfur was passed through a bed of silica gel maintained at a temperature of 40° C. and a pressure of 1824 kPa (250 psig) to produce a product stream containing less than 1 wppm oxidized sulfur as sulfones and a total sulfur concentration of about 8 wppm sulfur. The result was an ultra low sulfur diesel containing less than about 10 wppm total sulfur.

| Hydrotreated Diesel Analysis | |
|---|---|
| Total Sulfur, wppm | 130 |
| Total/Basic Nitrogen, wppm | 11/<10 |
| 1-Ring Aromatics, wt-% | 21.6 |
| 2-Ring Aromatics, wt-% | 4 |
| 3+ -Ring Aromatics, wt-% | 0.6 |
| Distillation | |
| IBP, ° C. | 209 |
| 5% | 230 |
| 10% | 237 |
| 90% | 306 |
| 95% | 321 |
| EBP | 326 |

The foregoing description, drawing and example clearly illustrate the advantages encompassed by the process of the present invention and the benefits to be afforded with the use thereof.

The invention claimed is:

1. A process for the production of organic hydroperoxides comprising:

(a) reacting, at a temperature from 110° C. (230° F.) to 170° C. (338° F.), a diesel boiling range hydrocarbon feedstock comprising hydrocarbons in the $C_9$ to $C_{23}$ range and having a boiling range from 140° C. (284° F.) to 380° C. (716° F.), oxygen and a recycle stream comprising hydrocarbons in the $C_9$ to $C_{23}$ range and organic hydroperoxides (OHP), in a steady state OHP concentration range from 50 to 5000 wppm oxygen as OHP, to produce a non-distilled product stream comprising hydrocarbons in the $C_9$ to $C_{23}$ range and an increased concentration of organic hydroperoxides;

(b) recycling at least a portion of the product stream comprising hydrocarbons in the $C_9$ to $C_{23}$ range and the increased concentration of organic hydroperoxides, wherein the at least a portion of the product stream is recycled to step (a) so that a steady state OHP concentration range is maintained; and (c) recovering a stream comprising hydrocarbons in the $C_9$ to $C_{23}$ range and organic hydroperoxides.

2. The process of claim 1 wherein the diesel boiling range hydrocarbon feedstock further comprises heterocyclic compounds containing sulfur.

3. The process of claim 1 wherein step (a) is conducted at a pressure from 100 kPa (0 psig) to 1824 kPa (250 psig).

4. The process of claim 1 wherein the weight ratio of the recycle stream to fresh feed is in the range from 0.1:1 to 4:1.

5. The process of claim 1 wherein the weight ratio of oxygen to fresh feed is in the range from 0.001:1 to 0.01:1.

6. A process for the production of organic hydroperoxides comprising:

(a) reacting, at a temperature from 110° C. (230° F.) to 170° C. (338° F.), a diesel boiling range hydrocarbon feedstock comprising hydrocarbons in the $C_9$ to $C_{23}$ range and having a boiling range from 140° C. (284° F.) to 380° C. (716° F.), oxygen and a recycle stream comprising hydrocarbons in the $C_9$ to $C_{23}$ range and organic hydroperoxides (OHP), in a steady state OHP concentration range from 50 to 5000 wppm oxygen as OHP, to produce a non-distilled product stream comprising hydrocarbons in the $C_9$ to $C_{23}$ range and an increased concentration of organic hydroperoxides;

(b) recycling at least a portion of the product stream comprising hydrocarbons in the $C_9$ to $C_{23}$ range and the increased concentration of organic hydroperoxides, wherein the at least a portion of the product stream is recycled to step (a) so that a steady state OHP concentration is maintained;

(c) recovering a stream comprising hydrocarbons in the $C_9$ to $C_{23}$ range and organic hydroperoxides; and (d) in an organic sulfur oxidation zone, reacting the stream comprising hydrocarbons in the $C_9$ to $C_{23}$ range and organic hydroperoxides in the presence of an organic sulfur oxidation catalyst to produce a stream comprising hydrocarbons in the $C_9$ to $C_{23}$ range and sulfone compounds.

7. The process of claim 6 wherein the diesel boiling range hydrocarbon feedstock further comprises heterocyclic compounds containing sulfur.

8. The process of claim 6 wherein step (a) is conducted at a pressure from 100 kPa (0 psig) to 1824 kPa (250 psig).

9. The process of claim 6 wherein the weight ratio of the recycle stream to fresh feed is in the range from 0.1:1 to 4:1.

10. The process of claim 6 wherein the weight ratio of oxygen to fresh feed is in the range from 0.001:1 to 0.01:1.

11. The process of claim 6 wherein the organic sulfur oxidation catalyst is selected from the group consisting of MoO3 and MgMoO4.

12. The process of claim 6 wherein the operating conditions in step (d) include a temperature from 49° C. (120° F.) to 180° C. (356° F.) and a pressure from 100 kPa (0 psig) to 3550 kPa (500 psig).

* * * * *